United States Patent [19]

Kelly et al.

[11] Patent Number: 4,589,493

[45] Date of Patent: May 20, 1986

[54] SUBSEA WELLHEAD PRODUCTION APPARATUS WITH A RETRIEVABLE SUBSEA CHOKE

[75] Inventors: Thomas P. Kelly; Edmund A. Fisher, both of Houston, Tex.

[73] Assignee: Cameron Iron Works, Inc., Houston, Tex.

[21] Appl. No.: 596,068

[22] Filed: Apr. 2, 1984

[51] Int. Cl.[4] ..... E21B 43/01

[52] U.S. Cl. ..... 166/341; 166/344; 137/798; 251/367

[58] Field of Search ..... 166/344, 347, 341, 338, 166/351; 285/157, 124; 251/367, 152, 153; 137/798

[56] References Cited

U.S. PATENT DOCUMENTS

| | | | |
|---|---|---|---|
| 2,276,883 | 3/1942 | Schön et al. | 285/157 |
| 3,688,840 | 9/1972 | Curington et al. | 166/341 |
| 3,820,558 | 6/1974 | Mueller | 251/367 X |
| 3,957,079 | 5/1976 | Whiteman | 166/338 X |
| 4,046,191 | 9/1977 | Neath | 166/352 |
| 4,210,208 | 7/1980 | Shanks | 166/352 |
| 4,457,489 | 7/1984 | Gilmore | 166/344 X |

*Primary Examiner*—James A. Leppink
*Assistant Examiner*—Hoang C. Dang
*Attorney, Agent, or Firm*—Vinson & Elkins

[57] ABSTRACT

A subsea wellhead production apparatus including a retrievable subsea choke having a body having an inlet, an outlet extending therein from its lower surface and a collet connecting flange surrounding the lower end of said body, a passage in said body defining communication between said inlet and said outlet, a valve seat in said body surrounding communication between said inlet and said outlet, a valve member movably mounted in said body to coact with said valve seat to control flow through said communication passage an actuator for moving said valve member toward and away from said valve seat, a flowline body having first and second passages opening on a surface of the body with a collet connecting flange surrounding said surface. An orienting key on said choke body and a muleshoe on said flowline body to orient and align said first passage with said inlet and said second passage with said outlet, and a remotely actuated collet connector surrounding and supported on said flowline body and having collet locking elements in position to engage the collet connecting flange.

7 Claims, 3 Drawing Figures

SUBSEA WELLHEAD PRODUCTION APPARATUS WITH A RETRIEVABLE SUBSEA CHOKE

BACKGROUND

When water depth becomes too great to economically allow the installation of fixed production platforms the wellhead trees are mounted subsea on the ocean floor. Due to the inaccessibility of the subsea tree, the producing well must be "killed" and the tree remotely retrieved and brought to the surface of the water for any maintenance that might be required. Due to the time and expense involved in "killing" the well and retrieving the tree, redundant pressure containing valves have been used or where possible the valves have been installed at the surface. Due to their potential for high wear rates, the adjustable chokes have previously been installed above the water surface. This has required a high pressure production flowline for each producing zone of each well in a given oil or gas field which would be routed from the subsea tree, along the ocean floor, to a gathering ship or platform. Also, since the various wells in a given field may not all have the same pressure their production cannot be comingled into one flowline and thereby use one surface located choke. Subsea chokes have been suggested for use in riser pressure equalization systems for controlling downhole pressure during drilling (U.S. Pat. No. 4,210,208) and to circulate out formation influx of a formation kick without having the choke on the drill ship (U.S. Pat. No. 4,046,191).

If the pressure reducing adjustable chokes could be installed directly onto the subsea trees then each well's reduced pressure production could be directed into a single subsea gathering line with it being necessary to route only this one single gathering line along the ocean floor instead of multiple high pressure flow lines.

SUMMARY

The present invention provides an improved retrievable subsea choke which has a body with an inlet and an outlet extending into said body from its lower surface which is surrounded by a collet connector flange, a passage extending s through the body to provide communication from the inlet to the outlet and with a valve seat surrounding such passage leading to the outlet, a valve chamber in the body with a valve member movably mounted in the valve chamber, means for moving the valve member toward and aways from the valve seat to control flow the valve.

An object of the present invention is to provide an improved retrievable subsea choke which can be retrieved from its connection to a subsea wellhead independent of the remainder of the components to which it is connected.

Another object is to provide an improved subsea choke which with its operator can be packaged as an assembly which may be lowered, landed and installed on a subsea wellhead and also may be independently retrievable from such subsea wellhead.

A further object is to provide an improved subsea choke which can be retrieved without the need of a diver.

BRIEF DESCRIPTION OF THE DRAWINGS

These and other objects and advantages of the present invention are hereinafter described and explained with reference to the drawings wherein.

DESCRIPTION OF THE PREFERRED EMBODIMENT

Figure 1:
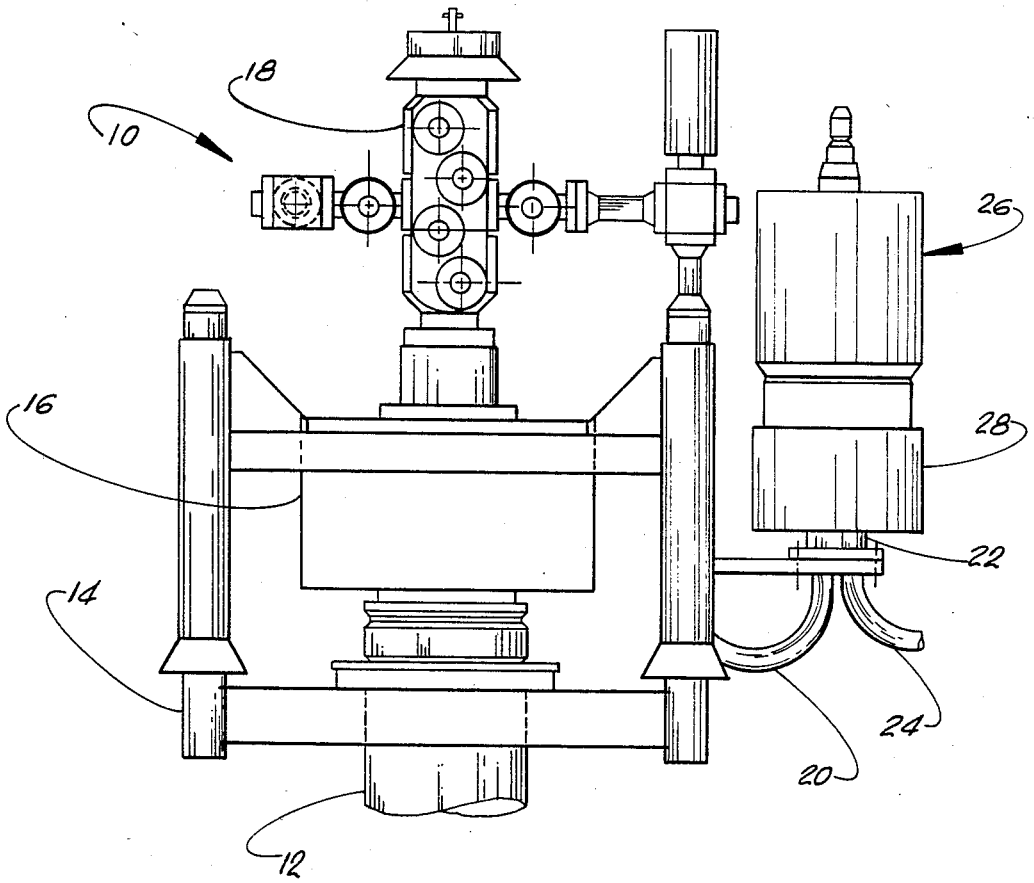
FIG. 1 is an elevation view of a deep subsea wellhead with the improved subsea choke of the present invention installed thereon.
Figure 2:
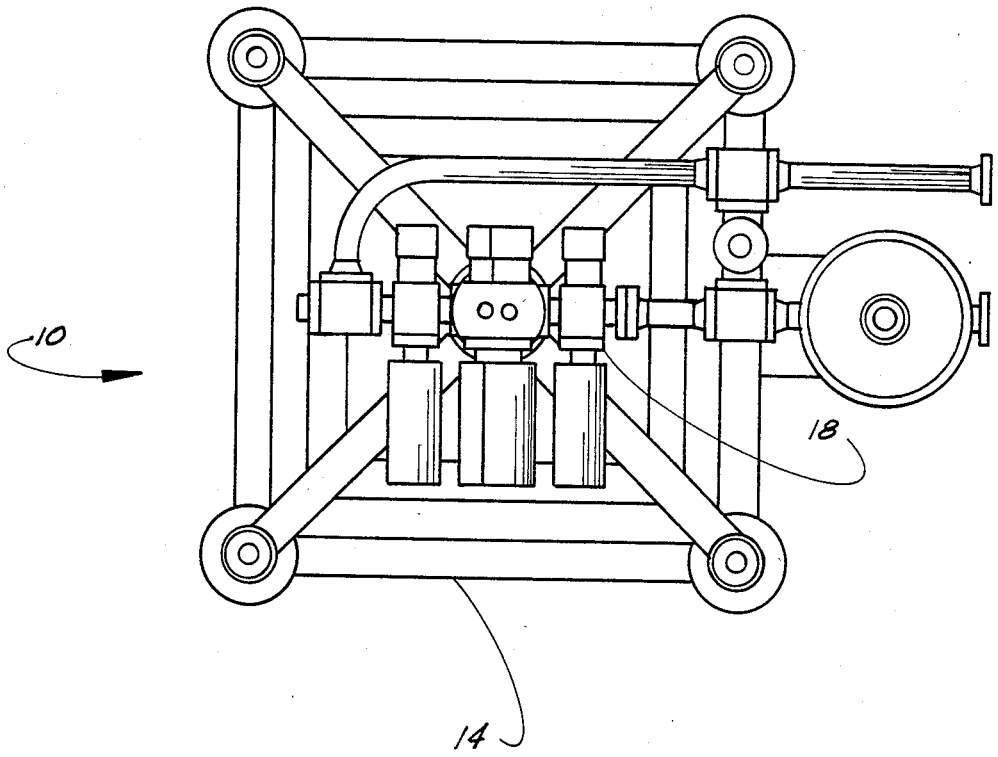
FIG. 2 is a plan view of the wellhead shown in FIG. 1.

As shown in FIGS. 1 and 2, subsea wellhead equipment 10 rests on the bottom and is connected to the upper end of well casing 12. Subsea wellhead equipment 10 is landed on guide base 14 and connected by remote control to well casing 12 by remotely controlled connector 16. Christmas tree 18 with its control valves forms a portion of wellhead equipment 10. Line 20 connects from the well production string to production flowline body or collet body 22 and line 24 connects from collet body 22 to the subsea flowline (not shown). Improved subsea choke assembly 26, as hereinafter described, is connected to collet body 22 by remotely controlled connection means such as collet connector 28. It should be noted that any other suitable remotely actuated connection means may be used with suitable preparation of the mating portions of body 22 and body 30, such as the connection means disclosed in U.S. Pat. No. 3,986,729.

Figure 3:
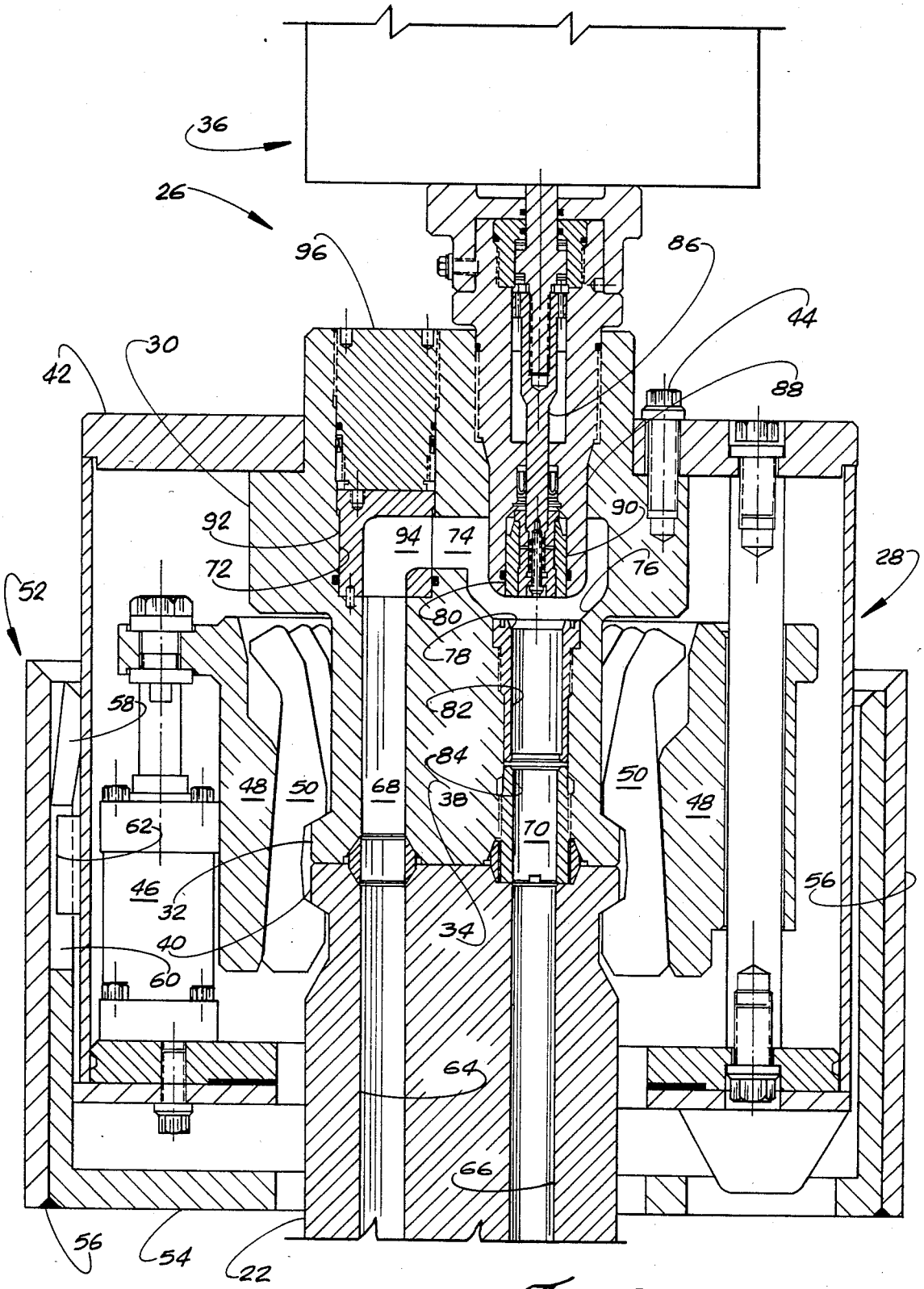
FIG. 3 is a detailed sectional view of the improved subsea choke the present invention.

As shown in FIG. 3, assembly 26 includes body 30 having collet flange 32 surrounding its lower surface 34, remotely controlled collet connector 28 and choke actuator 36. Collet body 22 includes upper surface 38 which is adapted to mate with surface 34 which is surrounded by collet flange 40. Collet connector 28 includes plate 42 which is suitably secured to body 30 by screws 44 and supports actuators 46 which move cam sleeve 48 to cause locking elements 50 to engage or release from flanges 32 and 40. Other connecting means which may be remotely actuated may be used, such as the circumferentially discontinuous locking ring structure disclosed in U.S. Pat. No. 3,986,729.

In order to ensure proper alignment of body 30 and collet body 22 orienting means 52 is provided. Such orienting means 52 includes plate 54 secured around collet body 22 and having upstanding annular collar 56 extending upwardly as shown from the periphery of plate 54. Mule shoe 58 is secured around the interior of collar 56 which terminates in slot 60. Also, orienting key 62 extending from the exterior of connector 28 is positioned to coact with mule shoe 58 and to engage in slot 60 and thus orient choke assembly 26 with respect to collet body 22 as it is lowered into position.

The structure of collet body 22 includes passage 64 which is connected to line 20 and passage 66 which is connected to line 24. Both passages 64 and 66 extend to and are open at surface 38. When body 30 has been landed on collet body 22, passage 64 is aligned with inlet 68 and passage 66 is aligned with outlet 70 and suitable sealing means, as shown, are provided to maintain sealed communication between these connections.

Body 30 includes chamber 72 which is in communication with inlet 68 and passage 74 extends through body 30 to valve chamber 76. Valve chamber 76 is in communication to outlet 70 through valve seat 78. Valve member 80 is mounted in body 30 as hereinafter described for movement toward and away from valve seat 78 to control the flow of production fluids therethrough. Valve seat 78 is defined by sleeve 82 which is threaded into the passage in body 30 leading to outlet 70 and is preferably of a material which is resistant to the erosive action of the fluids which may include some solids and which flow therethrough at substantial velocity. Outlet 70 is lined with sleeve 84 which extends beyond surface 34 to provide an erosion resistant lining for outlet 70.

Valve member 80 is mounted on shaft 86 which extends and provides the connection to actuator 36 and is supported in bushing 88 which is threaded into the opening of valve chamber 76 to the exterior upper surface of body 30. Valve member 80 includes erosion resistant sleeve 90 which is suitably mounted on shaft 86 and coacts with valve seat 78 to control flow.

Block 92 is positioned within chamber 72 and is preferably made of an erosion resistant material. Passage 94 extends through block 92 in the shape of an elbow to provide communication between passage 68 and passage 74. Since chamber 72 opens to the upper surface of body 30 in order for block 92 to be installed therein, plug 96 is secured therein and sealed to ensure that chamber 72 is sealed and the block 92 is secured in its desired position.

While the embodiment shown has the mating surfaces 34 and 38 on choke body 30 and collet body 22 being their lower and upper surfaces respectively these mating surfaces could be positioned vertically to be side surfaces or have some other orientation as long as they are mating and provide communication from passage 64 to inlet 68 and from outlet 70 to passage 66.

As may be seen from the foregoing description, the improved subsea choke is easily retrievable and it is retrievable without disturbing any of the wellhead equipment. It may be retrieved on a wire line, a drill pipe or by a remotely operated vehicle.

What is claimed is:

1. A subsea wellhead production apparatus comprising a subsea production flowline body having first and second passages opening on a surface of said body and means surrounding said body surface for coacting with a connecting means, a choke body having an inlet and an outlet extending therein from one of its surfaces and means surrounding said surface for coacting with a connecting means, means in said choke body for conducting flow from said inlet through a valve seat to said outlet, a valve member movably mounted in said body to coact with said valve seat to control flow through said valve seat, means for moving said valve member with respect to said valve seat, and remotely actuated means for releasably connecting said coacting means of said choke body to said coacting means of said flowline body with said first passage in communication with said inlet and said second passage in communication with said outlet whereby flow from said first passage to said second passage is controlled by said valve member.

2. An apparatus according to claim 1 including orienting means between said flowline body and said choke body to align said first passage with said inlet and said second passage with said outlet.

3. An apparatus according to claim 2 wherein said orienting means includes a mule shoe supported from said flowline body, and a key supported from said choke body in position to engage said mule shoe on landing of said choke body against said flowline body.

4. An apparatus according to claim 2 including means in said choke body and on said valve member for resisting erosion of fluids flowing therethrough.

5. An apparatus according to claim 2 wherein said connecting means includes a remotely actuated collet connector, and said coacting means includes collet flanges on said flowline body and said choke body for engagement by said collet connector.

6. A retrievable subsea choke comprising a body having an inlet and an outlet extending therein from one of its surfaces and a collect flange surrounding said surface for coacting with a remotely actuated releasable collet connector, means in said body for conducting flow from said inlet through a valve seat to said outlet, a valve member movably mounted in said body to coact with said valve seat to control flow through said valve seat, means for landing on a subsea wallhead, said body and a remotely actuated collect connector for connecting said body to a subsea production flowline to control flow from a subsea wellhead production line to a subsea flowline, and an orienting key mounted on said collect connected which is positioned to engage a subsea orienting device and provide proper orientation of said body and connector as they are landed at their intended subsea location.

7. A retrievable subsea choke comprising a body having an inlet and outlet extending therein from one of its surfaces and a collet flange surrounding said surface for coacting with a remotely actuated releasable collet connector, means in said body for conducting flow from said inlet through a valve seat to said outlet, a sleeve of erosion resistant material mounted in said conducting means leading to said outlet to define said valve seat, a valve member movably mounted in said body to coact with said valve seat to control flow through said valve seat and having a sleeve thereon of erosion resistant material, means for landing on a subsea wellhead, said body and a remotely actuated collect connector for connecting said body to a subsea production flowline to control flow from a subsea wellhead production line to a subsea flowline, an opening in said body in said conducting means between said inlet and said valve seat, a block of erosion resistant material positioned in said opening and defining an elbow in said conducting means, means for securing and sealing said block and said opening, and an orienting key mounted on said collet connector which is positioned to engage a subsea orienting device and provide proper orientation of said body and connector as they are landed at their intended subsea location.

* * * * *